US005636032A

United States Patent [19]

Springett

[11] Patent Number: 5,636,032

[45] Date of Patent: Jun. 3, 1997

[54] SYSTEM AND METHOD FOR INFORMING A USER OF A MARKING MATERIAL STATUS IN A PRINTING ENVIRONMENT

[75] Inventor: Brian E. Springett, Rochester, N.Y.

[73] Assignee: Xerox Corporation, Stamford, Conn.

[21] Appl. No.: 540,729

[22] Filed: Oct. 11, 1995

[51] Int. Cl.[6] ..... G03G 21/00

[52] U.S. Cl. ..... 358/296; 347/7; 399/23

[58] Field of Search ..... 355/203–11, 260, 355/308; 364/555, 525; 347/7

[56] References Cited

U.S. PATENT DOCUMENTS

| | | | |
|---|---|---|---|
| 3,409,901 | 11/1968 | Dost et al. | 346/74 |
| 4,468,112 | 8/1984 | Suzuki et al. | 355/14 D |
| 4,847,659 | 7/1989 | Resch, III | 355/202 |
| 4,908,666 | 3/1990 | Resch, III | 355/208 |
| 4,961,088 | 10/1990 | Gilliand et al. | 355/206 |
| 5,124,751 | 6/1992 | Fukui et al. | 355/246 |
| 5,204,698 | 4/1993 | LeSueur et al. | 346/160 |
| 5,204,699 | 4/1993 | Birnbaum et al. | 346/160 |
| 5,283,613 | 2/1994 | Midgley, Sr. | 355/203 |
| 5,459,559 | 10/1995 | Acqaviva et al. | 355/209 |
| 5,508,786 | 4/1996 | Ogiri et al. | 355/206 |

FOREIGN PATENT DOCUMENTS

| | | | |
|---|---|---|---|
| 4-275156A | 9/1992 | Japan | B41J 2/125 |
| 5-42680A | 2/1993 | Japan | B41J 2/175 |

*Primary Examiner*—Peter S. Wong
*Assistant Examiner*—Gregory J. Toatley, Jr.
*Attorney, Agent, or Firm*—Michael J. Nickerson

[57] ABSTRACT

A method and system for informing a user about characteristics of a marking material cartridge in a printing system. The system calculates a number of pixels being rendered in a present job and calculates an amount of marking material used to render the present job. The system also calculates a total area coverage to date for the marking material cartridge. Form this information an expected number of pages that the marking material cartridge can render is determined and displayed. The system determines a date when marking material in the marking material cartridge will be depleted and displays the date. The system also calculates an average coverage amount for a page being presently rendered. It can also calculate per page costs of the page currently being printed, and the pages printed to date. Additionally, the cost benefits of draft or other reduced print quality modes can be calculated and displayed. The method and system is equally applicable to black and white or color printing.

19 Claims, 4 Drawing Sheets

PAGE (J#) : 9 OF 16 PAGE SIZE: 8.5"X11"

PAGE AREA COVERAGE (PAC) :6.6%
JOB AREA COVERAGE [JAC]: 6.3%
AVERAGEE AREA COVERAGE TO DATE (AAC) : 6.0%

PAGES REMAINING AT AAC : 1000
PAGES REMAINING AT JAC : 950
PAGES REMAINING AT PAC : 900

PAGES RAMINING AT 6.3% AC : 950

EXPECTED REPLACEMENT DATE AT 6.3% AC: mm/dd/yy

COST PER PAGE [J#]: $ .02

PRINT MODE SAVINGS : 15%

15

FIG. 2

PAGE (J#) : 9 OF 16 PAGESIZE: 8.5"X 11"

PAGE AREA COVERAGE (PAC) :26% (C=12%; M=48%; Y=7%; K=33%)
JOB AREA COVERAGE [JAC]: 39% (C=12%; M=48%; Y=7%; K=33%)
AVERAGEE AREA COVERAGE TO DATE (AAC) : 63% (C=29%;M=33%;Y=25%;K=13%)

CYAN AVERAGE AREA COVERAGE [CACC]: 18%
PAGES REMAINING AT CAAC: 500
PAGES REMAINING AT CJAC; 1920
PAGES REMAINING AT CPAC: 2880
PAGES REMAINING AT 20% AC: 450
EXPECTED REPLACEMENT DATE AT 20% AC: mm/dd/yy

MAGENTA AVERAGE AREA COVERAGE [MACC]: 21%
PAGES REMAINING AT MACC: 1000
PAGES REMAINING AT MJAC: 1120
PAGES REMAINING AT MPAC: 1680
PAGES REMAINING AT 20% AC: 1050
EXPECTED REPLACEMENT DATE AT 20% AC: mm'/dd'/yy

YELLOW AVERAGE AREA COVERAGE [YACC]: 16%
PAGES REMAINING AT YACC: 1200
PAGES REMAINING AT YJAC: 7030
PAGES REMAINING AT YPAC: 10500
PAGES REMAINING AT 15% AC: 1280
EXPECTED REPLACEMENT DATE AT 15% AC: mm"/dd"/yy

BLACK AVERAGE AREA COVERAGE [KACC]: 8%
PAGES REMAINING AT KACC: 2000
PAGES REMAINING AT KJAC: 1250
PAGES REMAINING AT KPAC: 1860
PAGES REMAINING AT 10% AC: 1600
EXPECTED REPLACEMENT DATE AT 10% AC: mm'''/dd'''/yy

COST PER PAGE [J#]: $.12

PRINT MODE SAVINGS: 22%

150

FIG. 4

SYSTEM AND METHOD FOR INFORMING A USER OF A MARKING MATERIAL STATUS IN A PRINTING ENVIRONMENT

FIELD OF THE PRESENT INVENTION

The present invention is directed to a system and method of informing a user of a current status of the amount of marking material in a printing system. More specifically, the present invention is directed to a system and method for indicating to a user the number of pages remaining in a marking material cartridge before the cartridge will need replacing.

BACKGROUND OF THE PRESENT INVENTION

Conventionally, printing systems merely informed a user when the marking material was at a level too low to confidently print any further jobs. An example of such a system is disclosed in U.S. Pat. No. 4,961,088. The entire contents of U.S. Pat. No. 961,088 are hereby incorporated by reference.

As disclosed in U.S. Pat. No. 4,961,088, the conventional printing system uses a digital image generator to generate the image to be printed as an electronic pixel stream, which is tapped and sent to be both frequency or rate analyzed and also counted with a weighting factor assigned by the frequency analysis, to obtain a weighted pixel count. This provides a toner consumption estimate calculation which in turn can be subtracted from the (known) original amount of toner in the toner container to determine the remaining amount of toner and provide a signal indicating a low marking material condition.

In other words, U.S. Pat. No. 4,961,088 discloses that customer replaceable unit (CRU) a toner cartridge comes pre-filled with a specified (known constant) initial amount of toner. That number is stored as a weighted pixel count in a ROM, EPROM, or other non-volatile memory. As each page is printed, the pixel frequency is monitored for that page, and an estimation of the average image type is determined for that page. The number of pixels for page is then assigned a weight per pixel. This calculated toner amount is subtracted from the remaining balance of toner, and the new toner amount balance value is saved. The next page of pixels is then calculated and subtracted from this value. This process continues until the warning level for remaining toner is attained. The user is then alerted that the toner CRU is nearing it's "end-of-life" condition. The process continues until a calculated remaining toner amount of zero is attained, which should coincide with the toner cartridge being empty. That is, continuously subtracting calculated toner usage this way from the known initial installed toner amount until the balance amount reaches zero automatically gives an "out of toner" indication, without ever actually sensing or examining the toner container itself.

Other examples of conventional systems which have a low marking warning system are U.S. Pat. No. 5,283,613; U.S. Pat. No. 5,204,699; U.S. Pat. No. 5,204,698; U.S. Pat. No. 3,409,901; U.S. Pat. No. 4,847,659; U.S. Pat. No. 4,468,112; and U.S. Pat. No. 4,908,666. The entire contents of U.S. Pat. No. 5,283,613; U.S. Pat. No. 5,204,699; U.S. Pat. No. 5,204,698; U.S. Pat. No. 3,409,901; U.S. Pat. No. 4,847,659; U.S. Pat. No. 4,468,112; and U.S. Pat. No. 4,908,666 are hereby incorporated by reference.

One of the variables which is commonly encountered with an all in one toner or ink cartridge is that the customer prints documents with unknown amounts of area coverage. The print cartridge is purchased containing a finite amount of toner or ink and the customer is advised that the cartridge will deliver a certain number of prints at a certain area coverage; eg., for xerographic printers, this is commonly around 4,000 prints at a 6 percent area coverage. Since the customer is unaware of the area coverage which is to be utilized in specific jobs, the customer is really not aware of when a cartridge is about to be exhausted. Often the customer carries excess inventory to avoid being taken by surprise or else actually runs out of toner or ink. This situation is also true for standard toner or ink cartridges used in printers whether the printers produce black and white or color pages.

A problem associated with the conventional devices is that the user is only warned upon entering a low marking material condition and the user is not given an accurate prediction of the marking material depletion date of the marking material cartridge. More specifically, the conventional devices do not provide the user with a dynamic estimation as to the remaining life of the marking material cartridge so that the user can accurately plan the acquisition of new cartridges without having to have an undesirable amount of cartridges on hand in storage. Also, the user cannot accurately predict if a job can be completed without changing a marking material cartridge in the middle of the job.

In view of these problems, the present invention proposes a system which provides a user with information concerning the number of pages remaining in a marking material cartridge. The present invention also proposes a system which will predict a depletion date based on past job parameters so that a user can accurately plan future acquisitions of marking material cartridges.

SUMMARY OF THE PRESENT INVENTION

One aspect of the present invention is a system for informing a user about a life-expectancy of a marking material cartridge in a printing system. The system includes first means for calculating a number of pixels being rendered in a present job; second means, operatively connected to the first means, for calculating an amount of marking material used to render the present job; third means, operatively connected to the second means, for calculating a total area coverage to date; fourth means, operatively connected to the third means, for calculating an expected number of pages that the marking material cartridge can render based on the total area coverage; and display means for displaying the number of pages remaining in the marking material cartridge.

Another aspect of the present invention is a method for informing a user about characteristics of a marking material cartridge in a printing system. The method calculates a number of pixels being rendered in a present job; calculates an amount of marking material used to render the present job; calculates a total area coverage to date; calculates an expected number of pages that the marking material cartridge can render based on the total area coverage to date; and displays the number of pages remaining in the marking material cartridge.

Further objects and advantages of the present invention will become apparent from the following description of the various features of the present invention.

BRIEF DESCRIPTION OF THE DRAWINGS

The following is a brief description of each drawing used in describing the present invention, and thus, are being presented for illustrative purposes only and should not be limitative of the scope of the present invention, wherein:

FIG. 2 is an example of a display informing the user of the status of a black/white printing system according to the present invention;

FIG. 4 is an example of a display informing the user of the status of a color printing system according to the present invention.

DETAILED DESCRIPTION OF THE PRESENT INVENTION

Figure 1:
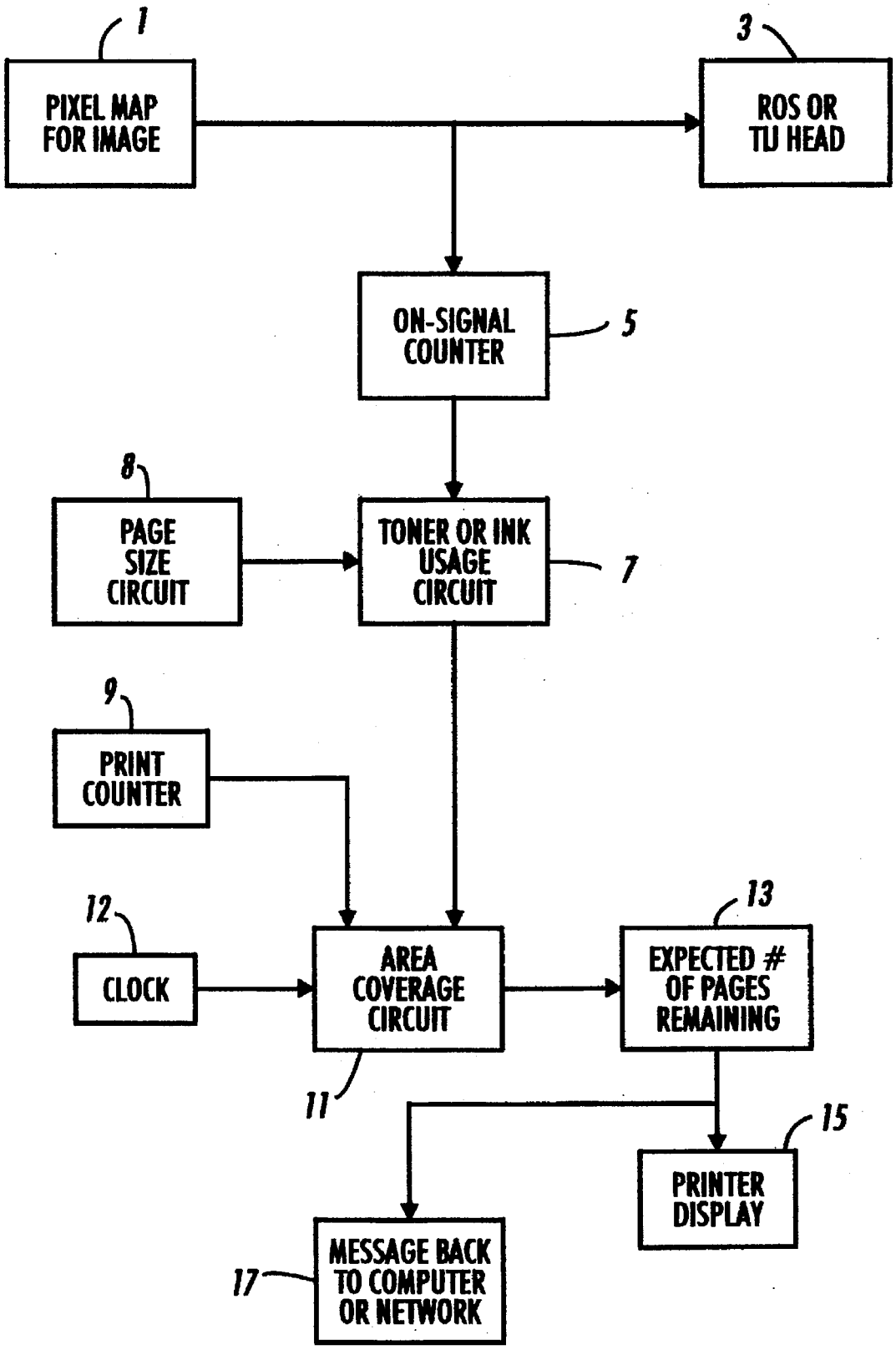
FIG. 1 is a block diagram illustrating the overall architecture of the remaining marking material calculation system of the present invention.

For a general understanding of the printing system incorporating the various features of the present invention, reference is made to the drawings. In the drawings and in the specification, like reference numerals have been used through out to designate identical or equivalent elements or steps.

FIG. 1 illustrates a block diagram showing the architecture for one preferred embodiment of the present invention. More specifically, as illustrated in FIG. 1, a pixel or bitmap for the image 1 is transmitted to a raster output scanner (ROS) or thermal ink jet (TIJ) head 3 for rendering the image on a recording substrate or medium. An ON signal counter 5 also receives the pixel or bitmap of the image 1 so that the number of printed pixels being rendered by the ROS or TIJ head, can be properly counted. The ON signal counter 5 is connected to a toner or ink usage circuit 7 which determines the amount of ink or toner utilized in printing the image by the ROS or TIJ head.

It is readily known to those of ordinary skill in the art that each pixel to be printed requires a fairly constant specific quantity of ink or toner, even in cases where some form of resolution enhancement or other print quality improvement image processing scheme is active. Every digital image is composed of a number of pixels to be printed. In the case of printing with discharge area development (DAD) or thermal inkjet, a laser or LED light exposure or ink injection occurs for each pixel to be printed. Each pixel to be printed requires a specific quantity of ink or toner to print it. This quantity can be measured and used in a look-up table in the toner or ink usage circuit. Further, this quantity is specific to the toner used and the printer electrophotographic set-up parameters. Thus, by simply counting the pixels to be printed, the toner or ink usage can be obtained.

This pixel counting is best done by monitoring the firing signal sequence of the optical raster output scanner or the thermal inkjet cartridge. If preventive maintenance intervals are required for the machine based on cycles for various components, this scheme can also be used to accumulate this information, and to inform the user or operator as necessary. The scheme can also be used to compute results for printing test pages built into the printer circuitry for diagnostic or print quality adjustment purposes.

Thus, knowing the number of pixels to be printed by the ROS or TIJ head 3, the toner or ink usage circuit 7 can directly calculate the amount of toner or ink utilized in printing the image. The toner or ink usage circuit 7 also includes a counter or small memory which stores the accumulated used toner or ink by the present toner or ink cartridge. This circuit also picks up a signal from page size circuit 8 indicating the size of the page being printed; e.g. 8.5"×11", A4, or A3 size paper.

An area coverage circuit 11 is connected to the toner or ink usage circuit 7. The area coverage circuit 11 calculates the area coverage of the image just rendered by the ROS or TIJ head 3. The area coverage circuit 11 also has accumulators or memory which retain the total area coverage since the last CRU replacement and the total area coverage for present job being rendered.

The toner or ink page coverage for a particular toner or ink cartridge is commonly calculated during the actual design of the cartridge. Each 8.5"×11" page has a theoretical number of pixels based upon the raster output scanner or thermal inkjet resolution. For example, if the output resolution is 400 dots per inch, the theoretical number of pixels for an 8.5"×11" page (assuming edge to edge printing) is 15,000,000 pixels. Therefore, a 5 percent coverage of the page would mean that 750,000 pixels would be counted or rendered.

The area coverage circuit 11 is connected to a print counter 9 and a pixel clock 11. The print counter 9 provides the number of prints which have been rendered so far utilizing the present toner or ink cartridge. Using this information and the total area coverage, the area coverage circuit 11 can calculate the average area coverage to date for the ink or toner cartridge being currently used. Thus, the area coverage circuit 11 can calculate the area coverage of a specific page, the average area coverage of a particular job, or an average area coverage to date for the toner or ink cartridge being currently used.

The area coverage of a specific page, the average area coverage of a job, and the average area coverage to date for the toner or ink cartridge is fed into an expected number of pages remaining circuit 13 which calculates: the number of pages remaining in the toner or ink cartridge utilizing the total average area of coverage to date; the number of pages remaining in the toner or ink cartridge utilizing the average area coverage of the latest rendered job; and the number of pages remaining in the toner or ink cartridge with respect to a preselected area coverage.

The expected number of pages remaining circuit 13 can also calculate the time remaining before a new toner or ink cartridge is needed. This information is calculated based on the usage rate per day provided by the area coverage circuit 11 when clock and calendar information is provided to the area coverage circuit 11.

Lastly, the expected number of pages remaining circuit 13 can calculate the cost per page with respect to the toner and ink usage as well as can calculate the cost reduction benefits of utilizing certain image processing modes such as draft modes.

The information calculated by the expected number of pages remaining circuit 13 is fed to a display 15 on the printer or sent back to a computer or network 17 so that the user can readily obtain this information. Moreover, the information can also be stored in a log on the printer, wherein the log can be printed onto a recording medium. Moreover, this log can also be printed out on a diagnostic document which is prestored in the printer.

FIG. 2 illustrates a detailed view of what display 15 may show when the present invention is fully implemented for a black/white printing system. According to a preferred embodiment of the present invention, the display 15, as illustrated in FIG. 2, displays the present page and the size of the page being printed for a particular job number (J#) which in the example illustrated by FIG. 2 is page 9 of 16.

The display also shows the area coverage of the particular page being printed (PAC) which in this example is 6.6 percent for page 9. Furthermore, the display 15 shows the average area coverage for the job being presently rendered (JAC) and the average area coverage to date for the cartridge being presently used (AAC) which are 6.3 percent and 6.0 percent, respectively, for this example.

The pages remaining with respect to the average area coverage, the pages remaining with respect to the average area coverage of the job being presently printed or just rendered and the pages remaining at a preselected area of coverage are displayed on the display 15 which in this example are 1,000,900, and 950, respectively. Lastly, the display 15 displays the expected replacement date for presently used cartridge as well as the cost per page for the particular job being presently rendered or just rendered. If the printer is in a marking material savings mode, the display will display the realized savings by printing this mode in lieu of printing in a normal mode.

It is noted that this information can also be printed as part of the log or displayed at the originating computer or other network citizen which is utilizing the printer.

Figure 3:
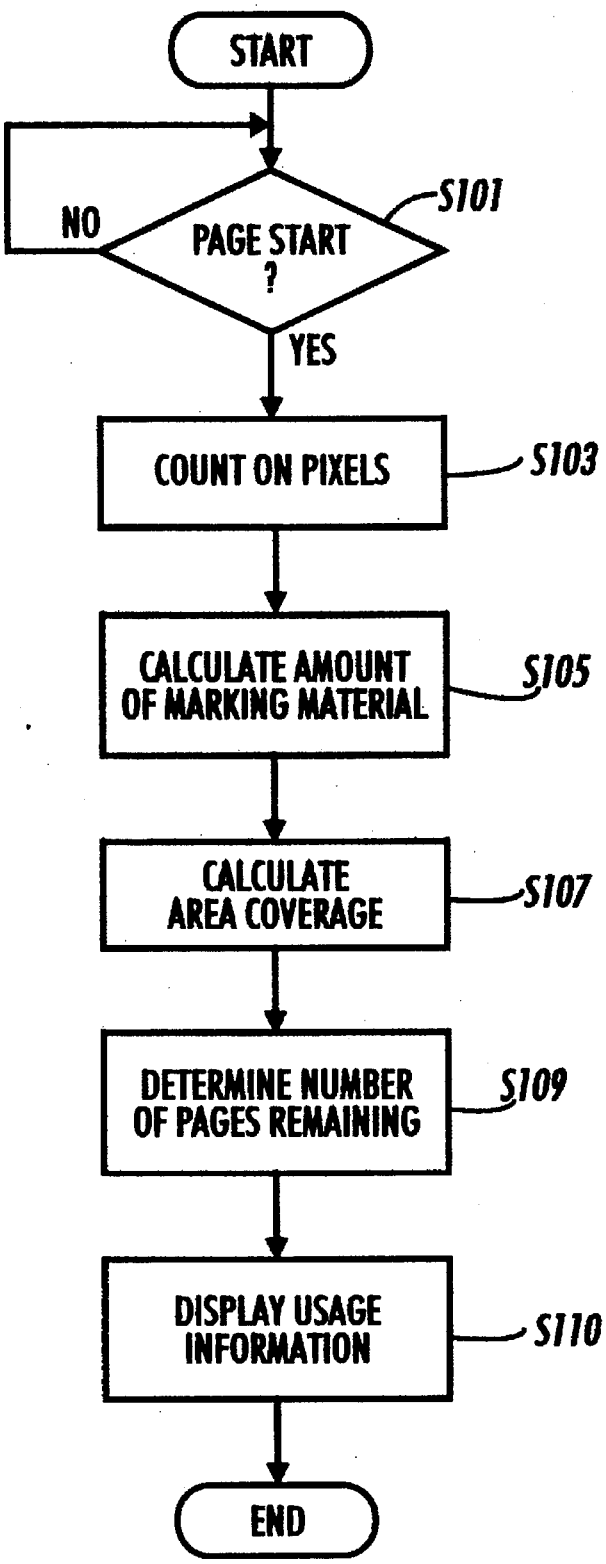
FIG. 3 is a flowchart illustrating a process carried out by the present invention.

FIG. 3 illustrates the process carried out by the present invention in determining the information described above. As illustrated in FIG. 6, step S101 determines whether a page start signal or job start signal has been received. If a page start signal or job start signal has been received, step S103 determines the number of ON pixels or pixels to be rendered when printing the particular page or job. Utilizing the number representing the ON pixel count, step S105 calculates the amount of marking material which will be utilized in rendering the image. The amount of marking material which is to be utilized in rendering the image is utilized by step S107 to calculate the various coverage amounts.

Subsequently, step S109 determines the number of pages remaining in the cartridge by utilizing the various calculated area coverage amounts and the number of images which have already been rendered. Lastly, step S110 displays the specific information described above with respect to FIG. 2 so that the user can make the proper decisions with respect to servicing or replacing the present toner or ink cartridge.

The present invention can be utilized with digital xerography (charge area development or discharge area development) independent of the exposure source (LED, laser diode or other optical shutter), and with inkjet (thermal piezoelectric, or hotmelt). Moreover, the present invention is not confined to a black and white environment, but can be readily adapted for a color environment. In the color environment, the information discussed above with respect to FIG. 2 can be displayed for individual color inks or toners (CMYK) as well as combined into an overall toner/ink usage. An example of such a display is shown in FIG. 4.

FIG. 4 illustrates a detailed view of what display 150 may show when the present invention is fully implemented for a color printing system. According to a preferred embodiment of the present invention, the display 150, as illustrated in FIG. 4, displays the present page and the size of the page being printed for a particular job number (J#) which in the example illustrated by FIG. 4 is page 3 of 5. The display also shows the comprehensive area coverage of the particular page being printed (PAC) which in this example is 26 percent for page 3 as well as the page area coverage for each individual colored marking material (C=12%; M=48%; Y=7%; K=33%). Furthermore, the display 150 shows the comprehensive average area coverage for the job being presently rendered (JAC) and the average area coverage to date for the cartridge being presently used (AAC) which are 39 percent and 63 percent, respectively, for this example as well as the job area coverage and the average area coverage to date for each individual colored marking material (C=12%; M=48%; Y=7%; K=33%) and (C=29%; M=33%; Y=25%; K=13%), respectively.

The display 150 break down the pages remaining with respect to the average area coverage, the pages remaining with respect to the average area coverage of the job being presently printed or just rendered, and the pages remaining at a preselected area of coverage. In the example illustrated in FIG. 4, the pages remaining with respect to the average area coverage (CAAC), the pages remaining with respect to the average area coverage of the job being presently printed or just rendered (CJAC), and the pages remaining at a preselected area of coverage (CPAC) for cyan are 500, 1920, 2880, respectively; the pages remaining with respect to the average area coverage (MAAC), the pages remaining with respect to the average area coverage of the job being presently printed or just rendered (MJAC), and the pages remaining at a preselected area of coverage (MPAC) for magenta are 1000, 1120, 1680, respectively; the pages remaining with respect to the average area coverage (YAAC), the pages remaining with respect to the average area coverage of the job being presently printed or just rendered (YJAC), and the pages remaining at a preselected area of coverage (YPAC) for yellow are 1200, 7030, 10500, respectively; and the pages remaining with respect to the average area coverage (KAAC), the pages remaining with respect to the average area coverage of the job being presently printed or just rendered (KJAC), and the pages remaining at a preselected area of coverage (KPAC) for black are 2000, 1250, 1860, respectively; . Lastly, the display 150 displays the expected replacement date for each of the presently used colored marking materials as well as the cost per page for the particular job being presently rendered or just rendered. If the printer is in a marking material savings mode, the display will display the realized savings by printing this mode in lieu of printing in a normal mode.

It is noted that this information, as in FIG. 2, can also be printed as part of the log or displayed at the originating computer or other network citizen which is utilizing the printer.

To calibrate the marking material's usage, the present invention utilizes a look-up table embedded in a permanent memory which provides the information corresponding to the rate of marking material used for printing according to the particular cartridge, printer, and marking material. This information is used for the computations required by step S105 in FIG. 3. Since this calibration is specific to the toner and printer set-up, a device or system is provided within the customer replaceable unit (CRU) or other marking material cartridge for recognition by the printer that the CRU or cartridge being used is the correct one for implementation of this monitoring system. If this recognition signal is not received, a message is sent to the user or operator indicating that an incorrect CRU or cartridge has been installed. The user can then take action to override this system, but the user is warned that the monitoring system will not be reliable.

The present invention provides a simple, low-cost system for a marking material consumption monitoring system or scheme for an electronic digital printer and/or digital copier and/or facsimile machine, whether printing in black and white or color. This monitoring is used to better predict in advance the marking material depletion replacement needs of a digital printer, and to signal or communicate that information to the user.

The disclosed system is particularly suitable for low-volume printers with relatively small toner cartridges requiring constant replacement. However, it can be utilized with any printer for which a high-cost or low reliability marking material sensor is undesirable.

While the present invention has been described with reference to various embodiments disclosed above, it is not confined to the details set forth above, but is intended to cover such modifications or changes as may come within the scope of the attached claims.

What is claimed is:

1. A system for informing a user about a life-expectancy of a marking material cartridge in a printing system, comprising:

a printer:

first means for calculating a number of pixels being rendered in a present job by said printer;

second means, operatively connected to said first means, for calculating an amount of marking material used to render the present job;

third means, operatively connected to said second means, for calculating a total area coverage to date;

fourth means, operatively connected to said third means, for calculating an expected number of pages that the marking material cartridge can render based on the total area coverage to date; and display means for displaying the number of pages remaining in the marking material cartridge.

2. The system as claimed in claim 1, wherein said fourth means determines a date when marking material in the marking material cartridge will be depleted.

3. The system as claimed in claim 2, wherein said display means displays said date when the marking material will be depleted.

4. The system as claimed in claim 1, wherein said third means calculates an average coverage amount for a page being presently rendered.

5. The system as claimed in claim 1, wherein said third means calculates an average coverage amount for a job being presently rendered.

6. The system as claimed in claim 1, wherein the printing system is a color system and said first, second, third, and fourth means perform the calculations for each color marking material.

7. The system as claimed in claim 1, wherein the marking material cartridge contains toner.

8. The system as claimed in claim 1, wherein the marking material cartridge contains ink.

9. The system as claimed in claim 1, wherein the marking material container comprises:

electronic signaling means for providing to said printer information identifying a type of marking material container being installed in the printing system.

10. The system as claimed in claim 7, wherein the marking material container comprises:

electronic signaling means for providing to said printer information identifying a type of marking material container being installed in the printing system.

11. The system as claimed in claim 8, wherein the marking material container comprises:

electronic signaling means for providing to said printer information identifying a type of marking material container being installed in the printing system.

12. A method for informing a user about characteristics of a marking material cartridge in a printing system, comprising:

(a) calculating a number of pixels being rendered in a present job by a printer;

(b) calculating an amount of marking material used to render the present job;

(c) calculating a total area coverage to date;

(d) calculating an expected number of pages that the marking material cartridge can render based on the total area coverage; and (e) displaying the number of pages remaining in the marking material cartridge.

13. The method as claimed in claim 12, wherein said step (d) determines a date when marking material in the marking material cartridge will be depleted.

14. The system as claimed in claim 13, wherein said step (e) displays the date when the marking material will be depleted.

15. The method as claimed in claim 12, wherein said step (c) calculates an average coverage amount for a page being presently rendered.

16. The method as claimed in claim 12, wherein said step (c) calculates an average coverage amount for a job being presently rendered.

17. The method as claimed in claim 12, further comprising the step of:

(f) placing the printing system into a marking material savings mode;

said step (c) calculating an amount of marking material saved using the marking material savings mode;

said step (e) displaying the amount of marking material saved.

18. The method as claimed in claim 12, wherein the printing system is color and said steps (a), (b), (c), and (d) perform the calculations for each color marking material.

19. The method as claimed in claim 12, further comprising the step of:

(f) providing to the printer information identifying a type of marking material container being installed in the printing system.

* * * * *